United States Patent [19]

Ishizu et al.

[11] Patent Number: 4,750,020

[45] Date of Patent: Jun. 7, 1988

[54] SHEET FEEDING APPARATUS

[75] Inventors: Hisao Ishizu, Tokyo; Yukitoshi Kiya, Kawasaki, both of Japan

[73] Assignee: Ricoh Company, Ltd., Tokyo, Japan

[21] Appl. No.: 847,729

[22] Filed: Apr. 3, 1986

[30] Foreign Application Priority Data

Apr. 3, 1985 [JP] Japan ..... 60-69173
May 8, 1985 [JP] Japan ..... 60-96017
Jan. 20, 1986 [JP] Japan ..... 61-8115

[51] Int. Cl.[4] ..... G03G 15/00
[52] U.S. Cl. ..... 355/14 SH; 355/3 SH
[58] Field of Search ..... 355/3 SH, 14 SH, 14 R; 271/902, 184, 263

[56] References Cited

U.S. PATENT DOCUMENTS 4,247,193 1/1981 Kaneko et al. ..... 355/14 R
4,586,813 5/1986 Ide ..... 355/14 SH

FOREIGN PATENT DOCUMENTS 40340 3/1977 Japan ..... 355/3 SH
157018 8/1983 Japan ..... 271/263

*Primary Examiner*—A. C. Prescott
*Assistant Examiner*—Ed Pipala
*Attorney, Agent, or Firm*—Oblon, Fisher, Spivak, McClelland & Maier

[57] ABSTRACT

A sheet feeding apparatus suitable for use in combination with an imaging system, such as a copier or printer, for feeding sheets of paper one by one to the imaging system is provided. The apparatus includes a predetermined path along which a sheet of paper is transported and a sensor for detecting the presence of a sheet of paper in a predetermined region of the path. When paper jamming of another sheet of paper is detected, if the sensor detects the presence of a sheet of paper in the predetermined region, a controller controls such that the sheet of paper in the predetermined region is transported in the reversed direction so that the sheet of paper is returned to a paper storing section for use in the next cycle of operation. With such a structure, any sheet of paper left unused in the travelling path when paper jamming of another sheet of paper has occurred is automatically returned to its storage so that the operator is not required to remove this unused sheet of paper.

11 Claims, 6 Drawing Sheets

SHEET FEEDING APPARATUS

BACKGROUND OF THE INVENTION

1. Field of the Invention

This invention relates to apparatus for feeding a sheet of paper one by one from a stack of sheets of paper, and, in particular, to a sheet feeding apparatus suitable for use in an imaging system, such as a printer, facsimile machine, or copier.

2. Description of the Prior Art

An imaging system using cut sheets of paper for forming an image thereon typically includes a paper feeding section where a number of cut sheets of paper are stored in the form of a stack and the sheets of paper are supplied one by one toward an imaging section. Such an imaging system includes a printer, facsimile machine, or copier, and in such a case, one or more of registration rollers are provided for synchronizing the operation at the imaging section and the sheet feeding operation. For example, in the case of a copier, a photosensitive drum is typically used to form thereon a toner image, which is then transferred to a cut sheet of paper supplied from the paper feeding section. In this case, a cut sheet of paper supplied from a stack of cut sheets of paper is once halted at the registration rollers, which are driven to rotate to advance the cut sheet of paper to be brought into contact with the photosensitive drum, thereby causing the toner image to be transferred from the drum to the cut sheet of paper.

In some cases, the distance from the paper storing section where a number of cut sheets of paper are stored in the form of a stack to the registration rollers is relatively long, so that, in the case of a continuous paper feeding operation, it is often encountered that the next following cut sheet of paper partly or wholly stays in a travelling path between the paper storing section and the registration rollers when the preceding cut sheet of paper is jammed. If this happens, the operator is required to remove not only the jammed cut sheet of paper, but also the next following cut sheet of paper which is partly or wholly present in the travelling path between the paper storing section and the registration rollers. In this case, the operator has to open an outer cover of the imaging system so as to access to the travelling path in which the sheet of paper stays for manual removal thereof. This is quite disadvantageous.

Moreover, in the case where the cut sheet of paper used is relatively large in size, e.g., A3 or B4 size, it is very likely that the leading portion of the cut sheet of paper has already reached at the image transfer station when the cut sheet of paper has come to a halt due to jamming of the preceding cut sheet of paper. In this case, on the cut sheet of paper is partly formed a toner image which has not yet been permanently fixed to the cut sheet of paper, so that when the cut sheet of paper is pulled out of the system, the toner could be removed from the cut sheet of paper being pulled out to smear the registration rollers, paper feed rollers, guide plates, or any other associated elements in the system.

SUMMARY OF THE INVENTION

In accordance with the present invention, a paper feed roller is provided to be reversibly rotatable, and the paper feed roller is driven to rotate in the reversed direction when the presence of a sheet of paper in a travelling path from a paper storing section to a predetermined location is detected and also paper jamming is detected. That is, the paper feed roller is normally driven to rotate in the normal direction so that the sheets of recording paper stored in the form of a stack in the paper storing section are fed one by one by the paper feed roller. However, when one or more of the preceding sheets of paper are jammed while being transported along a predetermined path, there is generated a detection signal indicating the occurrence of paper jamming. At the same time, when detecting means for detecting the presence of a sheet of paper in the travelling path from the paper storing section to the predetermined location generates another detection signal indicating the presence of a cut sheet of paper in this travelling path, it is so controlled that the paper feed roller is driven to rotate in the reversed direction so that the cut sheet of paper in this travelling path is moved back to the paper storing section.

It is therefore a primary object of the present invention to obviate the disadvantage of the prior art as described above and to provide an improved paper feeding apparatus.

Another object of the present invention is to provide an improved paper feeding apparatus capable of disposing of a sheet of paper half or just supplied from a paper storing section when one or more of the preceding sheets of paper have been jammed while being transported.

A further object of the present invention is to provide a paper feeding apparatus having an increased convenience.

A still further object of the present invention is to provide an improved paper feeding apparatus particularly suitable for use in combination with an imaging system, such as a copier, printer, or facsimile machine.

Other objects, advantages and novel features of the present invention will become apparent from the following detailed description of the invention when considered in conjunction with the accompanying drawings.

DESCRIPTION OF THE PREFERRED EMBODIMENTS

Figure 1:
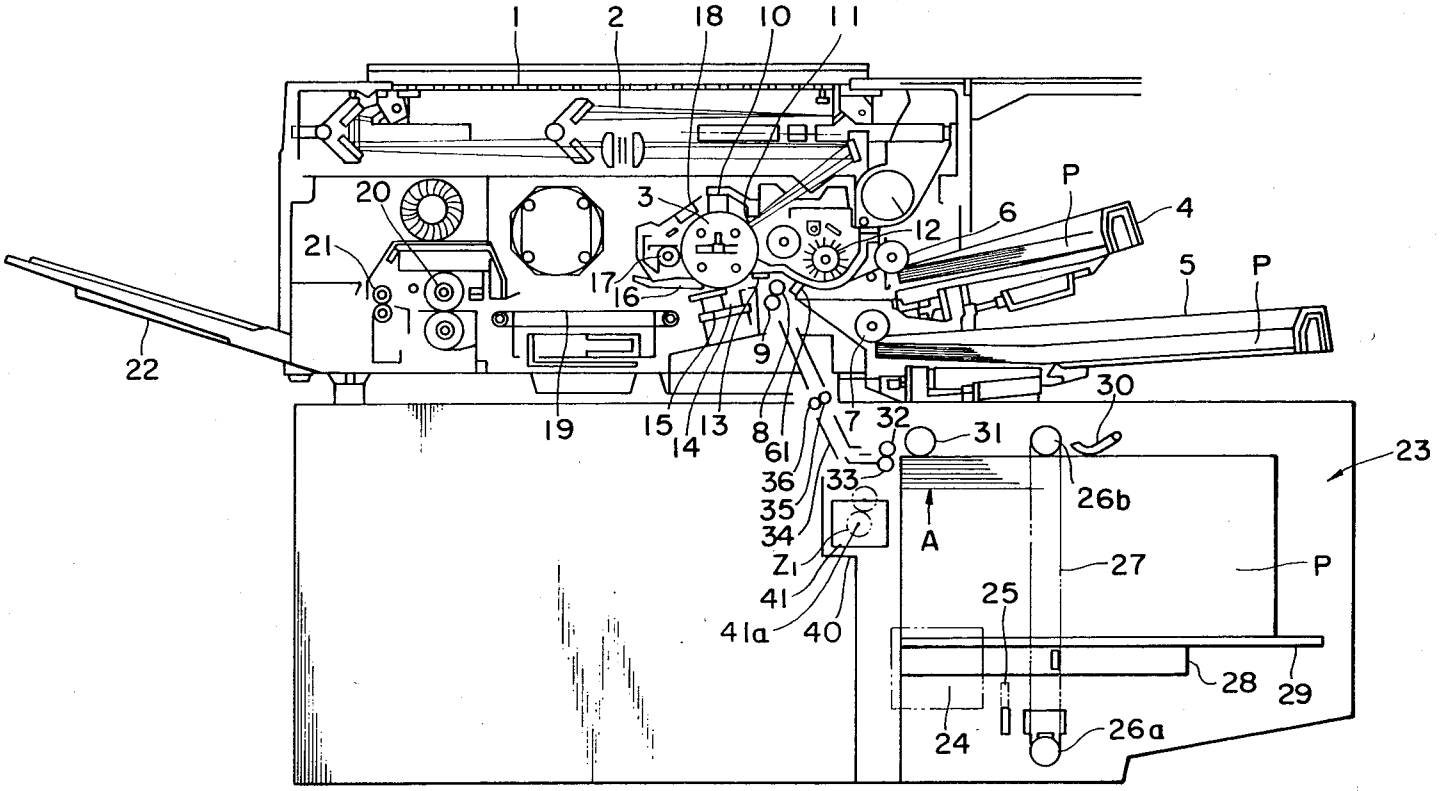
FIG. 1 is a schematic illustration showing an electrophotographic copying machine to which a sheet feeding apparatus constructed in accordance with one embodiment of the present invention has been incorporated.

Referring now to FIG. 1, there is schematically shown an electrophotographic copying machine having incorporated therein a paper feeding apparatus constructed in accordance with one embodiment of the present invention. As shown, the copying machine includes a contact glass plate 1 disposed on top extending horizontally, on which an original document from which one or more copies are to be made is placed stationary with its original surface facing downward. Below the contact glass plate 1 is disposed an optical scanning system 2 and a photosensitive drum 3, which is driven to rotate in a predetermined direction, or clockwise direction in the illustrated embodiment, at constant speed. Thus, the light reflecting from the original on the contact glass plate 1 is directed to impinge on the peripheral surface of the drum 3 by means of the optical scanning system 2.

The illustrated copying machine is provided with a dual type paper feeding apparatus including a pair of paper cassettes 4 and 5, which are detachably mounted in position. Each of the cassettes 4 and 5 store therein a number of cut sheets of paper P in the form of a stack, and paper feed rollers 6 and 7 are rotatably provided in a main body of the copying machine so as to be located at the supply end of the respective cassettes 4 and 5 when detachably mounted in position. The paper feed rollers 6 and 7 are selectively driven to rotate so that the sheets of paper P are fed one by one from either one of the cassettes 4 and 5. A pair of registration rollers 8 and 9 is disposed at a location close to the drum 3 and a travelling path is defined from the supply end of each of the cassettes 4 and 5 to the location where the pair of registration rollers 8 and 9 is disposed. Thus, when either one of the paper feed rollers 6 and 7 is selected and thus driven to rotate, the topmost sheet of paper P of the paper stack in the selected one of the cassettes 4 and 5 is fed toward the pair of registration rollers 8 and 9, where the sheet of paper P thus supplied is temporarily halted and then again transported to be brought into contact with the peripheral surface of the drum 3 at an image transfer station in association with the rotation of the drum 3.

As shown in FIG. 1, around the periphery of the drum 3 are disposed various imaging components well known to one skilled in the art, and they include, as arranged in the order of rotation of the drum 3, a charging device 10 for uniformly charging the peripheral surface of the drum 3 in a predetermined polarity, an eraser unit 11 for removing the uniform charge from a predetermined section of the peripheral surface of the drum 3 by irradiation prior to image exposure by the optical scanning system 2, a developing device 12 for developing an electrostatic latent image formed on the drum 3 by image exposure by the optical scanning system 2 with application of toner to form a toner image, a charge-removing lamp and P-sensor 13 for removing the charge from the toner image prior to image transfer, an image transfer unit 14 where the toner image is transferred from the drum 3 to the cut sheet of paper P supplied from the present paper feeding apparatus, a sheet removing unit 15 for removing the cut sheet of paper P from the drum 3 after image transfer, a fur brush cleaning roller 17 for removing the residual toner from the drum 3, and a charge-removing lamp 18 for removing the residual charge from the drum 18 prior to the next cycle of operation.

In operation, the drum 3 is driven to rotate in the clockwise direction at constant speed, and as the drum 3 rotates, its peripheral surface is charged uniformly in a predetermined polarity by means of the charging device 10, and the charge is selectively dissipated according to a light pattern of an original image exposed by the optical scanning system 2 so that an electrostatic latent image is formed on the drum 3. As the drum 3 further rotates, the latent image is developed by the developing device 12 so that the latent image is converted into a visible toner image.

On the other hand, a cut sheet of paper P is supplied from one of the cassettes 4 and 5 selectively and it is temporarily interrupted by the pair of registration rollers 8 and 9. In association with the rotation of the drum 3, the pair of registration rollers 8 and 9 is driven to rotate so that the sheet of paper P is caused to advance by the pair of registration rollers 8 and 9 to be brought into an image transfer station where the sheet of paper P is brought into contact with the peripheral surface of the drum 3. With the application of an appropriate voltage of appropriate polarity to the image transfer corona device 14, the toner image is transferred from the drum 3 to the sheet of paper P in contact with the drum 3 when the sheet of paper P travels through the image transfer station. As the drum 3 further rotates, the sheet of paper P in contact with the drum 3 comes to be separated from the drum 3 by means of the separating corona unit 15, and, thus, the sheet of paper P now separates from the drum 3 to advance onto a transport belt 19, which then transports the sheet of paper P having thereon the transferred toner image to pass between a pair of image fixing rollers 20, where the toner image becomes permanently fixed to the sheet of paper P. Thereafter, the sheet of paper P is discharged onto a copy tray 22 by means of a pair of paper discharging rollers 21.

Below the paper cassettes 4 and 5 is disposed a large volume paper feeding device 23 which is not constructed in the form of a detachable cassette, but capable of storing therein a large number of cut sheets of paper P as compared with either of the paper cassettes 4 and 5. In the illustrated embodiment, the large volume paper feeding device 23 includes a reversibly rotatable drive motor 24, a table drive lower pulley **26*a*. operatively coupled to the drive motor 24 through a transmission gear 25, a table drive upper pulley 26*b*, an endless belt 27 extending between the lower and upper pulleys 26*a* and 26*b*, a table 28 fixedly connected at a point to the endless belt 27, and a holder plate 29 mounted on the table 28 for holding thereon a quantity of sheets of paper P in the form of a stack. The drive motor 24 is driven to rotate either in the normal direction or reversed direction in accordance with a control signal supplied from a control section, so that the endless belt 27 is driven to move the table 28** upwardly or downwardly selectively.

Also provided is a height detection lever 30 which comes into contact with the topmost sheet of the stack placed on the holder plate 29 so as to detect the height or the quantity of sheets of paper P stacked on the holder plate 29. The large volume sheet feeding device 23 is provided with a paper supply port A where a pick-up or paper feed roller 31 is rotatably disposed so as to be in contact with the top surface of the topmost sheet of paper P of the stack. Also provided downstream of the paper feed roller 31 with respect to the direction of advancement of a sheet of paper P is a feed roller 32 and a separate roller 33 which are so disposed to define a pair. Also provided are guide plates 34 which extend from the paired feed and separate rollers 32 and 33 in a predetermined inclined direction to define a travelling path leading toward the location where the pair of registration rollers 8 and 9 is disposed. Also provided are an intermediate drive roller 35 and an intermediate follower roller 36, which are paired and serve as transportation rollers.

Figure 2:
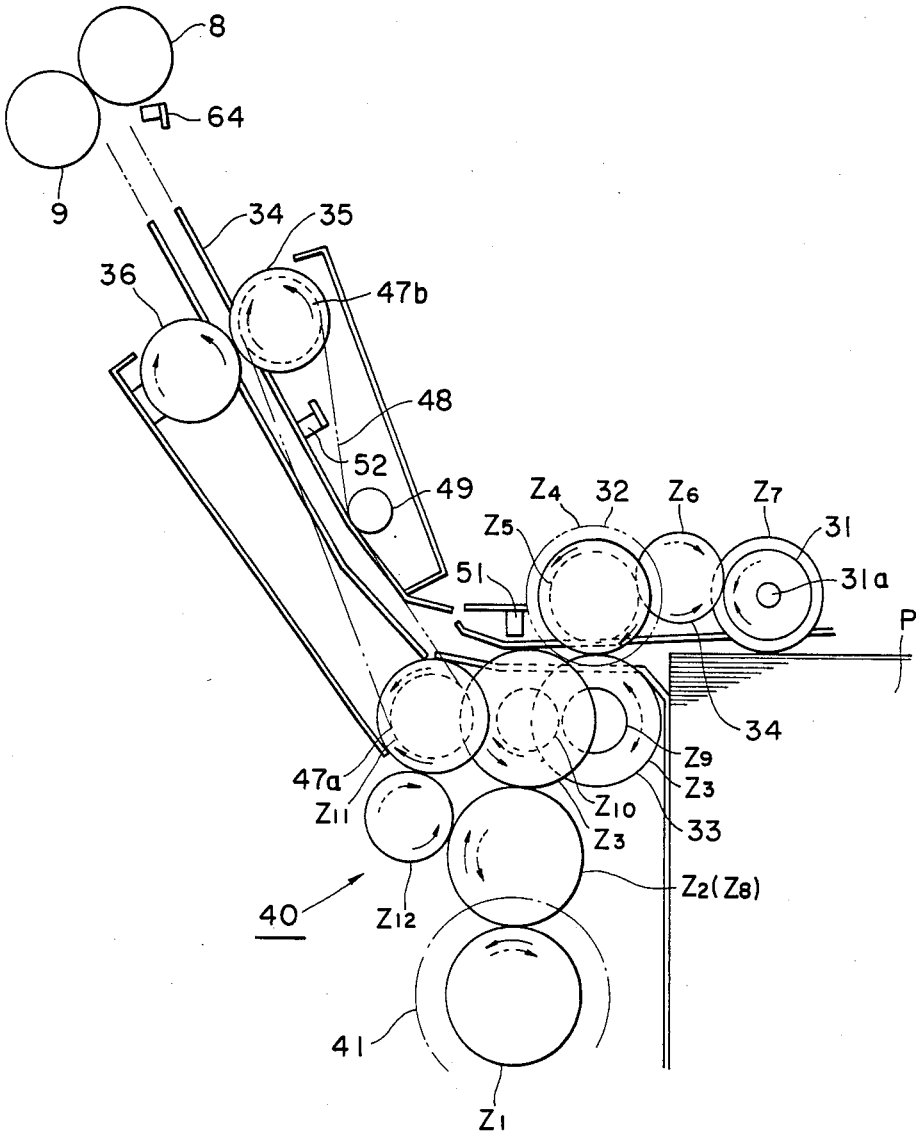
FIG. 2 is a schematic illustration showing a part of the structure shown in FIG. 1 more in detail.
Figure 3:
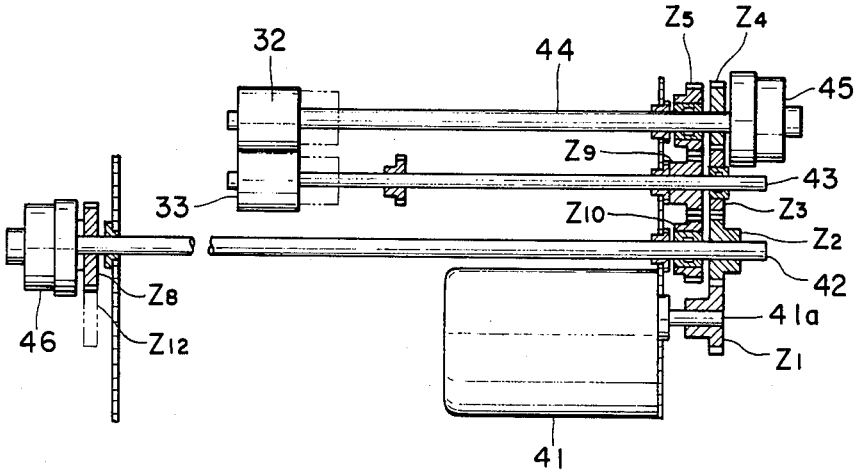
FIG. 3 is a schematic illustration showing a part of the structure shown in FIG. 2 when viewed from right.

All of the rollers mentioned above are driven to rotate by a roller driving system 40 which includes a reversibly rotatable paper feed drive motor 41 disposed adjacent to the large volume paper feeding device 23. The drive motor 41 has a drive shaft 41*a* on which is fixedly mounted a first gear Z1, from which a rotational driving force is transmitted to various transport rollers, such as paper feed roller 31, feed roller 32, separate roller 33, and intermediate rollers 35 and 36, through various gear trains. That is, as shown in FIGS. 2 and 3, the first gear Z1 is in mesh with a second gear Z2 fixedly mounted on a first shaft 42, and the second gear Z2 is in mesh with a third gear Z3 fixedly mounted on a second shaft 43. And, the third gear Z3 is in mesh with an electromagnetic clutch gear Z4 of a normal rotation electromagnetic clutch 45 which is supported on a third shaft 44. The third shaft 44 carries thereon the feed roller 32 and it also supports thereon a fourth gear Z5, which is operatively coupled to a six gear Z7 fixedly mounted on a fourth shaft 31*a*, which supports the paper feed roller 31, through a fifth gear Z6. A seventh gear Z9 is fixedly mounted on the second shaft 43 and it is in mesh with an eighth gear Z10. And, the second shaft 43 supports thereon the separate roller 33.

Figure 4:
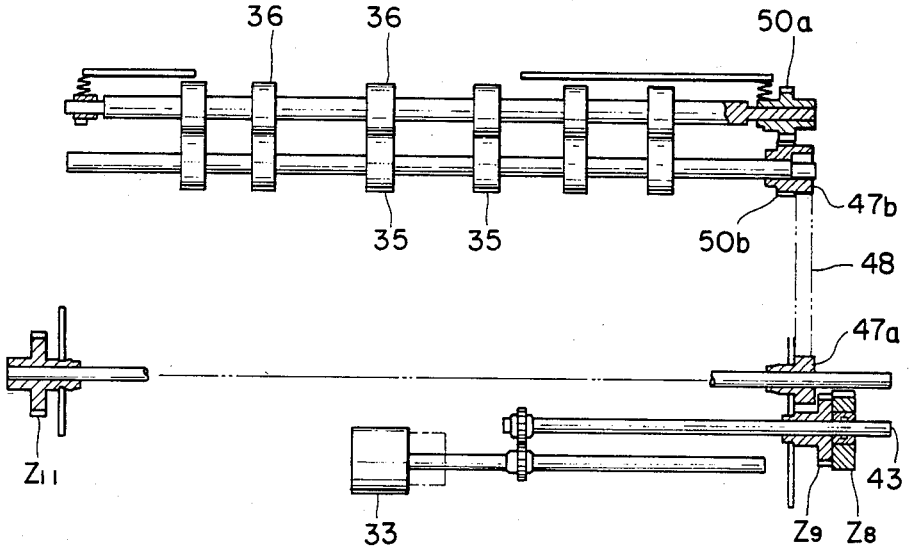
FIG. 4 is a schematic illustration showing another part of the structure shown in FIG. 2 when viewed from right.

Furthermore, as shown in FIG. 3, at the left end of the first shaft 42 as viewing into FIG. 3, a clutch gear Z8 of a reversed rotation electromagnetic clutch 46 is supported, and this clutch gear Z8 is in mesh with a ninth gear Z12 which, in turn, is meshed with a tenth gear Z11 having the pulley 47*a* as shown in FIG. 2. The pulley 47*a* is operatively coupled to the pulley 47*b* which is mounted on the same shaft as one of the intermediate rollers 35 and 36 (roller 35 in the illustrated embodiment) through an endless belt 48. Also provided is a tension roller 49 at a position somewhere between the pulleys 47*a* and 47*b* for keeping the belt 48 in tension. It is to be noted that, although not shown specifically, each of the third, fourth, and eighth gears Z3, Z5 and Z10 includes a one-way clutch as incorporated therein. As shown in FIG. 2, in the neighborhood of the feed roller 32 and also of the intermediate rollers 35 and 36 are disposed a pair of first sensors 51 and 52 for detecting whether or not a sheet of paper P stays in this region. Also in the neighborhood of the pair of registration rollers 8 and 9 is disposed a second sensor 64 for detecting whether or not the leading portion of a sheet of paper P has reached an image transfer station where the image transfer unit 14 is disposed. The pair of first sensors 51 and 52 are arranged spaced apart from each other over a predetermined distance along the paper travelling path from the feed roller 32 to the paired intermediate rollers 35 and 36 and the second sensor 64 is disposed close to and immediately before the paired registration rollers 8 and 9 with respect to the direction of advancement of a sheet of paper P in the illustrated embodiment. The first and second sensors 51, 52 and 64 may be each comprised, for example, of a reflection type photosensor. As shown in FIG. 4, the pair of intermediate rollers 35 and 36 are operatively coupled through respectively associated gears 50*a* and 50*b* which are in mesh.

A description will be made as to the operation of the present paper feeding apparatus structured as described above. It is to be noted that the direction of rotation of the rollers and gears for transporting a sheet of paper P toward the photosensitive drum 3 will be referred to as normal direction; whereas, the direction of rotation of the rollers and gears for moving a sheet of paper P toward the device 23, which defines a paper storing section, will be referred to as reversed direction. And, in FIG. 2, when the first gear Z1 of the feed drive motor 41 is driven to rotate counterclockwise, the rollers will rotate in the normal direction as indicated by the solid arrows in FIG. 2; on the other hand, when a sheet of paper P is to be moved backward toward the device 23, the first gear Z1 is driven to rotate in the direction indicated by the dotted arrow in FIG. 2 so that all of the rollers also rotate in the direction indicated by the dotted arrows.

During normal rotation, the first gear Z1 rotates counterclockwise in FIG. 2 and its rotational driving force is transmitted to the second gear Z2, third gear Z3, and electromagnetic clutch gear Z4. In this case, an electrogmagnet 45 is energized so that the electoromagnetic clutch gear Z4 also rotates in the normal direction, and, therefore, both of the feed and separate rollers 32 and 33 rotate in the normal direction. In addition, through the fourth and fifth gears Z5 and Z6, the paper feed roller 31 also rotates in the normal direction, thereby causing the topmost sheet of the paper stack to be supplied through the supply port A of the device 23. In association therewith, the first shaft 42, on which the second gear Z2 is fixedly mounted, also rotates in the normal direction, which causes the clutch gear Z8 (reverse rotation electromagnetic clutch 46 is deenergized), ninth gear Z12 and tenth gear Z11 to rotate in the normal direction, thereby rotating the paired intermediate rollers 35 and 36 through the pulley 47*a*, belt 48 and pulley 47*b* to carry out transportation of a sheet of paper P.

In the case where paper jamming occurs while sheets of paper P are supplied continuously as described above, if there is generated a signal indicating the occurrence of paper jamming, a sheet of paper P is detected to be present between the intermeditate rollers 35, 36 and the feed roller 32 by the first sensor 51, 52, and the second sensor 64 indicates the absence of any sheet of paper at its location, then in response to this AND signal, the feed drive motor 41 is driven to rotate in the reversed direction so that the first gear Z1 also rotates in the reversed direction. In this case, the normal rotation electromagnetic clutch 45 is deenergized and the reverse rotation electromagnetic clutch 46 is energized.

As a result, the electromagnetic clutch gear Z4 becomes idle so that no rotational driving force is transmitted to the feed and separate rollers 32 and 33. On the other hand, the reversed rotation of the first shaft 42 now causes the clutch gear Z8, ninth gear Z12 and tenth gear Z11 to rotate in thereversed direction. With this, the pulley 47*a*, belt 48 and pulley 47*b* operate in the reversed direction so that the paired intermediate rollers 35 and 36 are driven to rotate in the reversed direction. As a result, any sheet of paper P staying in the travelling path between the feed roller 32 and the intermediate rollers 8 and 9 is moved backward toward the device 23.

Figure 5:
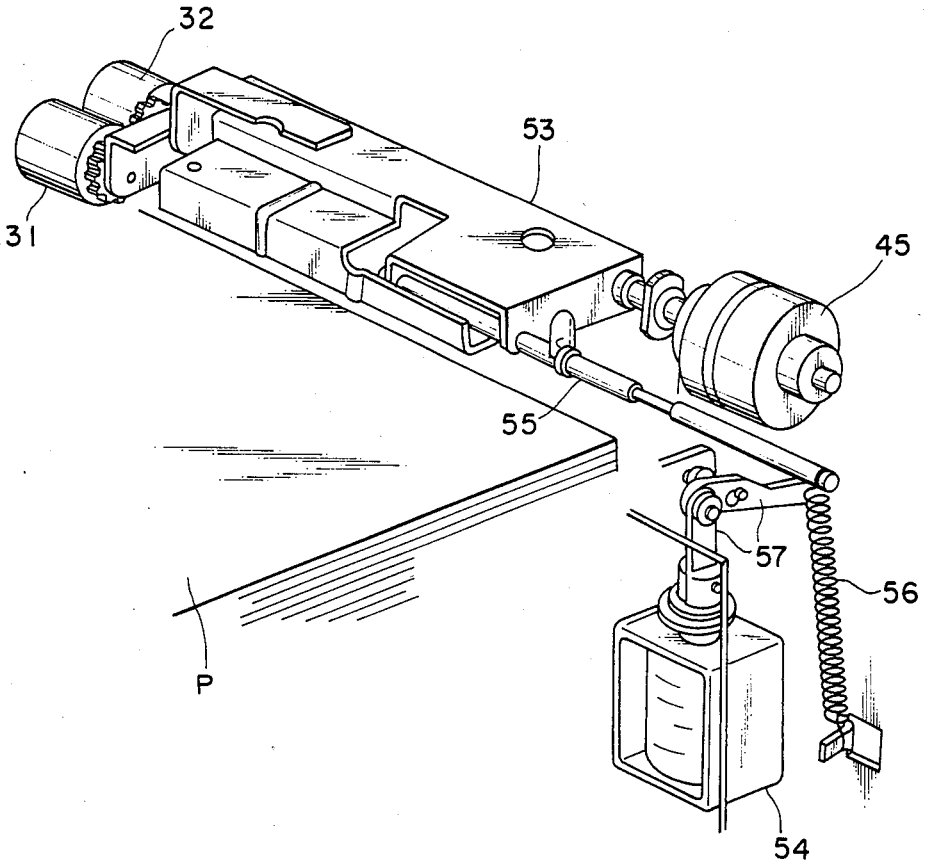
FIG. 5 is a fragmentary, perspective view showing a lift mechanism for lifting selected rollers as desired, which constitutes a part of the paper feeding apparatus shown in FIGS. 1 through 4.

Incidentally, if the paper feed roller 31 and the feed roller 32 are located in the paper travelling path during this backward transportation of a sheet of paper P, the sheet of paper P may come to interfere with any one or both of these rollers 31 and 32 and thus there is a chance that the sheet of paper P may not be moved backward smoothly. For this reason, it is preferable that the rollers 31 and 32 be vertically movable. As shown in FIG. 5, in the preferred embodiment, there is provided a support frame 53 which rotatably supports the paper feed roller 31 and the feed roller 32. The support frame 53 is so provided to be vertically movable, pivotally or translationally, and the support frame 53 is moved to its raised position during a time period of backward transportation of a sheet of paper P. For this purpose, a pin 55 is provided as extending horizontally from the support frame 53 and a spring 56 is provided as extending between the pin 55 and a housing such that the rollers 31 and 32 are normally biased to their lowered position. Also provided is a solenoid 54 having an arm 57 which can move to its advanced position or to its retracted position depending on the state of the solenoid 54 and which is operatively connected to the pin 55. Thus, when the solenoid 54 is energized, the rollers 31 and 32 are moved to their raised position against the recovery force of the spring 56; on the other hand, when the solenoid 54 is deenergized, the rollers 31 and 32 are moved to their lowered position by the recovery force of the spring 56. Upon completion of backward transportion of a sheet of paper P, the solenoid 54 is deenergized so that the rollers 31 and 32 are moved to their lowered position so that the paper feed roller 31 comes to be pressed against the topmost sheet of paper P of the paper stack, which has just been retured by the backward transportation.

Preferably, during this mode of backward transportation, the drive motor 24 is driven to rotate in a predetermined direction over a predetermined amount so as to lower the table 28 of the sheet feeding device 23 slightly over a predetermined amount. With this, a gap is defined between the topmost sheet of the paper stack on the holder plate 29 and the paper feed roller 31, which contributes to transport a sheet of paper P in the backward direction onto the paper stack.

If the second sensor 64 generates a signal indicating the presence of a sheet of paper P at its location while a signal indicating the occurrence of paper jamming is being generated, the print operation is brought to a halt immediately. This is the condition in which the leading portion of a long sheet of paper P in use has already reached the image transfer station where the image transfer unit 14 is disposed. If the backward transportation described above were to be carried out under the condition, the toner, which have just been transferred to the sheet of paper P and not yet been fixed to the sheet of paper P, would contaminate the registration rollers 8 and 9, feed roller 32, separate roller 33, intermediate rollers 35 and 36 and guide plates 34. In view of this in accordance with the illustrated embodiment, if the second sensor 64 detects the presence of a sheet of paper P at its location, an imaging operation, e.g., print or copy operation, is halted, and the sheet of paper P left in the travelling path is not automatically subjected to backward transportation. In this case, the sheet of paper P left in the travelling path must be removed manually together with the jammed sheet of paper P.

Figure 6:
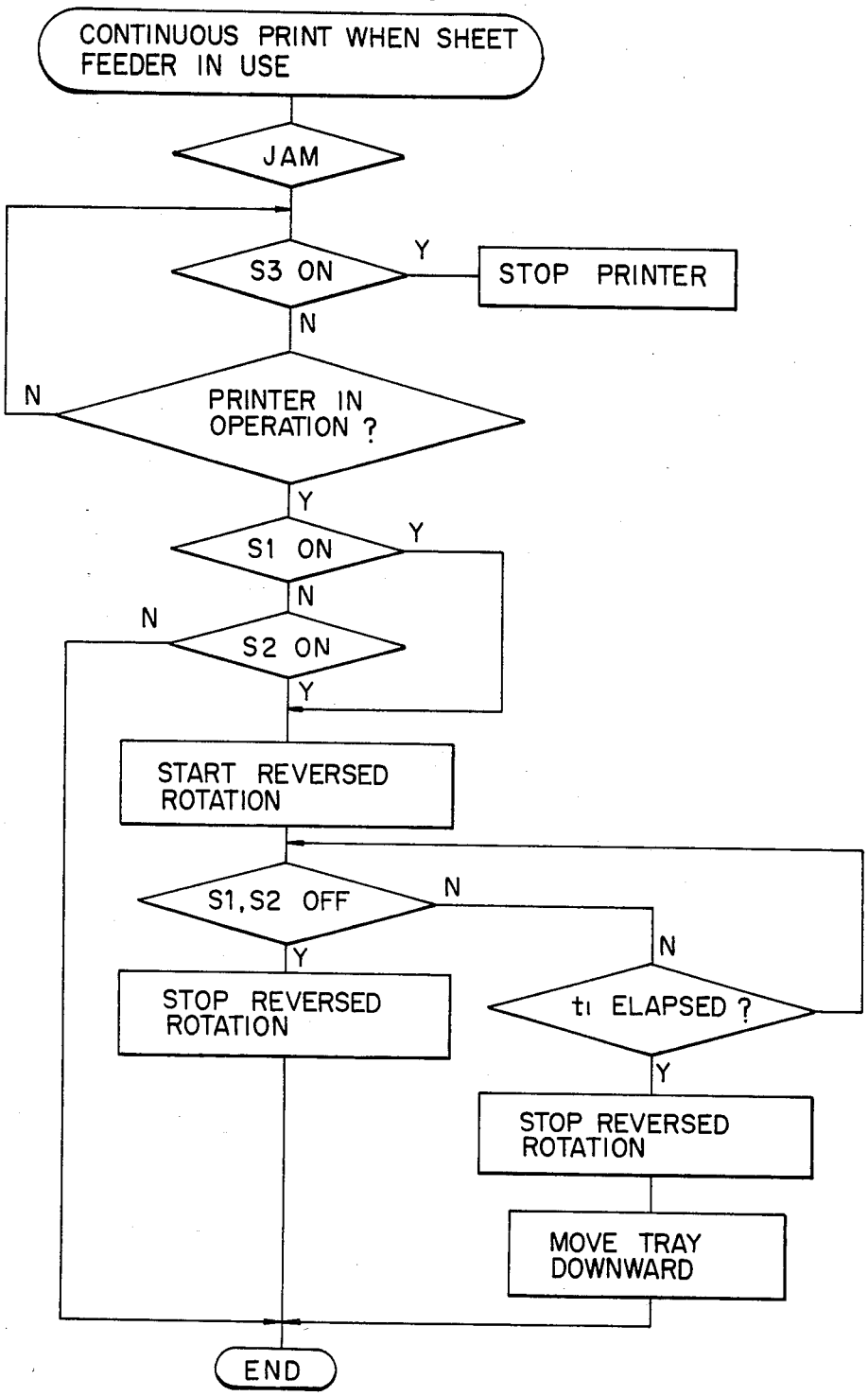
FIG. 6 is a flow chart useful for explaining the operation of the present paper feeding apparatus.

The sequence of operational steps of this embodiment is shown in the form of a flow chart in FIG. 6. Described with reference to FIG. 6, during a continuous print operation using the sheet feeding device 23, if the second sensor (S3) 64 detects the fact that the leading portion of the sheet of paper P in the travelling path has reached the image transfer station when paper jamming has occurred, a copy operation is halted immediately.

On the other hand, if the second sensor 64 generates a signal indicating the absence of a sheet of paper P when paper jamming has occurred, a copy operation is stopped, but, in this case, if both of the first sensors 51 (S1) and 52 (S2) indicate the absence of a sheet of paper P in this region, the sheet feeding device 23 remains intact to wait for the next cycle of operation.

On the contrary, if the either one of the first sensors 51 (S1) and 52 (S2) indicates the presence of a sheet of paper P in this region, the rollers are driven to rotate in the reversed direction to establish the mode of backward transportation, so that the sheet of paper P remaining in the travelling path is caused to move backward onto the top of the paper stack in the sheet feeding device 23. In this case, this mode of backward transportation is terminated at the time when both of the first sensors 51 (S1) and 52 (S2) are turned off to indicate the absence of a sheet of paper P in this region. However, if either one of the first sensors 51 (S1) and 52 (S2) remains on even if a predetermined time period (t1) has elapsed, it is decided that the sheet of paper P remaining in the travelling path cannot be moved back to the sheet feeding device 23, so that the backward transportation is terminated and the sheet feeding device 23 is moved downward over a predetermined distance so as to allow the sheet of paper P remaining in the travelling path to be removed without trouble. Such a sequence of operation is controlled by a later-described control section of the apparatus.

Figure 7:
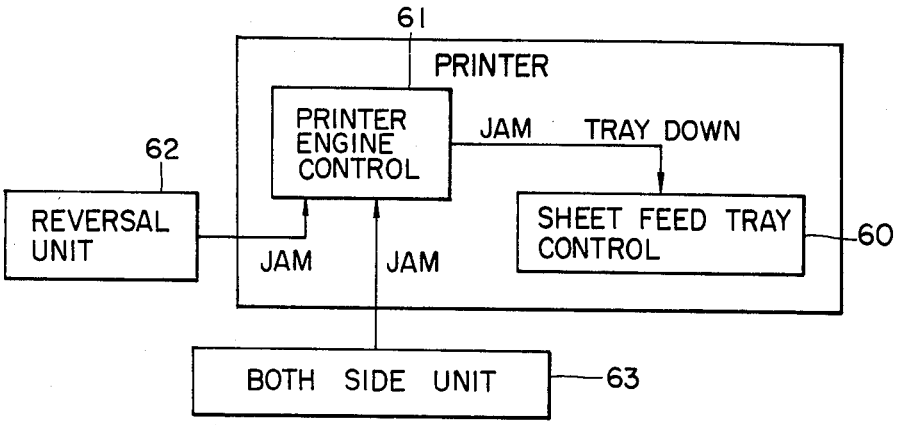
FIGS. 7 through 10 are schematic illustrations showing several system examples having incorporated therein the present paper feeding apparatus.
Figure 8:
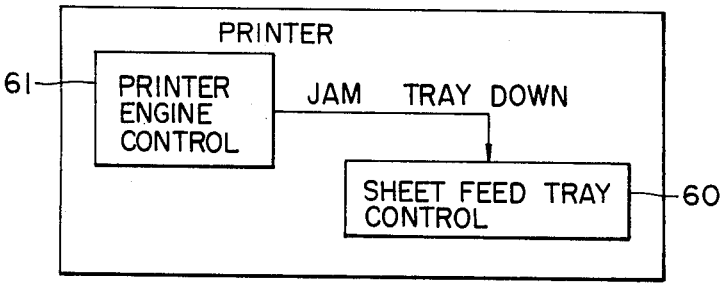
Figure 9:
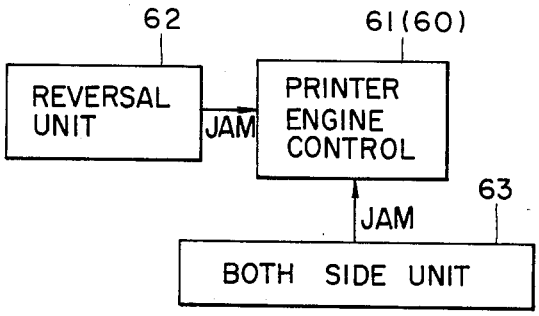
Figure 10:
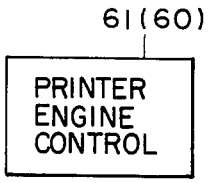

FIGS. 7 through 10 show several examples of a system embodying the present invention. FIGS. 7 and 8 show the case in which a controller 60 for controlling the above-described backward transportation is provided as incorporated in the sheet feeding device 23 separately from a controller 61 for controlling the printing or copying operation. FIGS. 9 and 10 show the case in which the controller of the backward transportation is incorporated into the controller 61 of the printer or copier. In FIGS. 7 and 9, a reversal unit 62 is a unit for turning a sheet of paper upside down, for example, for both-sided copying operation as well known to one skilled in the art, and a both side unit 63 indicates a well-known mechanism for copying both sides of a sheet of paper. Furthermore, in FIGS. 7 and 9, it is indicated that the mechanism of backward transportation is controlled in accordance with a signal indicating the occurrence of paper jamming from a peripheral device, such as reversal unit 62 or both side unit 63.

It is to be noted that in the above-described backward transportation mechanism, it is preferable that the rotational speed of the feed drive motor 41 in the reversed direction be slower than the rotational speed in the normal direction so as to prevent any damage, such as wrinkling, or another paper jamming from taking place when the sheet of paper P is driven to move in the backward direction. Described more in detail in this respect, when the sheet feeding apparatus is halted due to the occurrence of paper jamming, a sheet of paper P, which is also brought to a halt, may be slightly warped because it is partly pinched between paired rollers. Under the condition, if the feed drive motor 41 is driven to rotate in the reversed direction at the same high speed as that of the normal rotation, e.g., 200 to 250 mm/sec, the sheet of paper P tends to become skewed, which could then cause wrinkles to the sheet of paper P and/or cause another paper jamming. For this reason, when the feed drive motor 41 is driven to rotate in the reversed direction, it is preferable that the motor 41 be driven to rotate at a slower speed, for example, of 30 to 50 mm/sec if the rotational speed in the normal direction ranges between 200 and 250 mm/sec because it would contribute to prevent any damage to the sheet of paper P to be returned or another paper jamming from taking place.

As an alternative structure, the second sensor 64 may be eliminated, if desired. In this case, if either one of the second sensors 51 and 52 detects the presence of a sheet of paper P in the region of interest while a signal indicating the occurrence of paper jamming is being generated, the feed drive motor 41 is driven to rotate in the reversed direction. Moreover, in such an alternative structure, when paper jamming has occurred during a continuous copying or printing operation using the sheet feeding device 23, the copying or printing operation is immediately halted. It should also be noted that a signal indicating the occurrence of paper jamming may be generated any manner well known in the art, for example, using a timer.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A sheet feeding apparatus comprising:

(a) guiding means for guiding a sheet of paper to move along a predetermined path;

(b) transporting means for transporting the sheet of paper along said predetermined path;

(c) first sensing means for sensing the presence of the sheet of paper in a predetermined region along said predetermined path; and (d) control means for controlling said transporting means such that the sheet of paper is normally transported in a first direction along said predetermined path and the sheet of paper is transported in a second direction opposite to said first direction along said predetermined path when the sheet of paper is detected to be present in said predetermined region by said first sensing means upon occurrence of paper jamming of another sheet of paper.

2. Apparatus of claim 1 wherein said transporting means includes a plurality of rollers disposed at desired locations along said predetermined path and rotatably supported, a reversibly rotatable motor, and a power transmission train extending between said motor and each of said plurality of rollers, whereby said motor is normally driven to rotate in a first rotational direction to cause the sheet of paper to be transported in said first direction and said motor is driven to rotate in a second rotational direction opposite to said first rotational direction to cause the sheet of paper to be transported to said second direction.

3. Apparatus of claim 2 further comprising storing means for storing a quantity of sheets of paper in the form of a stack from which said sheets of paper is fed into said guiding means one by one.

4. Apparatus of claim 3 wherein said second direction is a direction to move the sheet of paper toward said storing means.

5. Apparatus of claim 4 further comprising second sensing means for sensing the presence of a sheet of paper at a predetermined location of said predetermined path.

6. Apparatus of claim 5 wherein said control means causes said transporting means to transport the sheet of paper in said predetermined region in said second direction only when said second sensing means indicates the absence of a sheet of paper at said predetermined location even if said first sensing means senses the presence of a sheet of paper in said predetermined region together with an occurrence of paper jamming of another sheet of paper.

7. Apparatus of claim 6 wherein said apparatus is combined with an imaging system including an image transfer station where a toner image is transferred from an imaging member to a sheet of paper, and wherein said predetermined location where said second sensing means is located is a position such that at least a portion of a sheet of paper is present in said image transfer station when the presence of the sheet of paper is detected by said second sensing means.

8. Apparatus of claim 6 wherein the sheet of paper is transported slower in said second direction than in said first direction.

9. Apparatus of claim 4 wherein said plurality of rollers include at least one roller which is normally pressed against the topmost sheet of said paper stack and said apparatus further includes first positioning means for positioning said at least one roller between a raised position separated away from said paper stack and a lowered position in pressure contact with the topmost sheet of said paper stack, whereby said first positioning means causes said at least one roller to be located at said raised position while the sheet of paper is being transported in said second direction.

10. Apparatus of claim 4 wherein said plurality of rollers include at least one roller which is normally pressed against the topmost sheet of said paper stack and said apparatus further includes second positioning means for positioning said paper stack normally at a first position where the topmost sheet of said paper stack is pressed against said at least one roller and for positioning said paper stack at a second position where the topmost sheet of said paper stack is separated away from said at least one roller to provide a gap therebetween to allow the sheet of paper moving in said second direction to ride on said paper stack.

11. Apparatus of claim 10 wherein said second positioning means causes said paper stack to move to said second position if said first sensing means still detects the presence of a sheet of paper in said predetermined region after a mode of transporting in said second direction has been operated over a predetermined time period.

* * * * *